US005305703A

United States Patent [19]

Korsgaard

[11] Patent Number: 5,305,703

[45] Date of Patent: Apr. 26, 1994

[54] VESSEL MOORING SYSTEM

[76] Inventor: Jens Korsgaard, 318 North Post Rd., Princeton Junction, N.J. 08550

[21] Appl. No.: 19,401

[22] Filed: Feb. 18, 1993

Related U.S. Application Data

[63] Continuation-in-part of Ser. No. 998,986, Dec. 31, 1992, abandoned.

[51] Int. Cl.[5] ..... B63B 22/02

[52] U.S. Cl. ..... 114/230; 441/4

[58] Field of Search ..... 441/3-5; 114/230, 293; 166/352-355

[56] References Cited

U.S. PATENT DOCUMENTS

| | | | |
|---|---|---|---|
| 3,440,671 | 4/1969 | Smulders | 9/8 |
| 3,529,919 | 9/1970 | Tiraspolsky | 114/206 |
| 3,605,668 | 9/1971 | Morgan | 114/.5 |
| 3,620,181 | 11/1971 | Naczkowski | 114/.5 D |
| 3,974,794 | 8/1976 | Kakitani | 114/230 |
| 4,321,720 | 3/1982 | Havre | 114/5 |
| 4,604,961 | 8/1986 | Ortloff | 114/230 |
| 4,606,727 | 8/1986 | Koenig | 441/5 |
| 4,639,228 | 1/1987 | Bulow | 441/5 |
| 4,698,038 | 10/1987 | Key et al. | 441/5 |
| 4,765,378 | 8/1988 | Engelskirchen | 141/696 |
| 4,892,495 | 1/1990 | Svensen | 441/55 |
| 5,025,742 | 6/1991 | Urdshals | 114/230 |
| 5,025,743 | 6/1991 | Pollack | 114/230 |
| 5,052,322 | 10/1991 | Poldervaart | 114/230 |
| 5,113,778 | 5/1992 | Paasche | 114/256 |

*Primary Examiner*—Edwin L. Swinehart
*Attorney, Agent, or Firm*—Kenyon & Kenyon

[57] ABSTRACT

A vessel with a mooring recess on the bottom of the hull moors to a submerged buoyant mooring element anchored to the ocean bottom by hoisting the mooring element from a stowed position at a depth of net neutral buoyancy of the mooring element and its anchoring system into contact with the mooring recess. The mooring operation is completed safely, quickly, and positively by rapidly withdrawing seawater into the hull through an opening in the mooring recess so as to reduce the hydrostatic pressure acting on the top of the mooring element as the element comes into contact with the hull of the vessel. The pressure reduction is sufficient to shift the mooring element and its anchoring system from a net negative to a net positive buoyancy condition at the keel depth of the vessel. The seawater may be withdrawn by a high capacity pump that is either specifically installed for this purpose or is part of a bow thruster system of a type commonly found on large vessels. Alternative, or additional, seawater suction apparatus includes an evacuated hermetic chamber having a valve opening into the mooring recess. The mooring recess may be coaxial with a vertical well in the hull, in which case water in the well may be drained into an empty hold through a valve opening into the well near the bottom of the hull. The mooring element has an upper part that makes sealing contact with the hull of the vessel and a lower part that is connected to the anchor lines. At least one bearing mounted between the parts permit the upper part to rotate relative to the lower part, so that the vessel may weathervane in response to wind, wave, and current forces.

21 Claims, 11 Drawing Sheets

VESSEL MOORING SYSTEM

CROSS-REFERENCE TO RELATED APPLICATION

This is a continuation-in-part of U.S. Patent application Ser. No. 07/998,986 filed on Dec. 31, 1992, now abandoned.

BACKGROUND OF THE INVENTION

Field of the Invention

This invention relates generally to the mooring of oil tankers or other vessels in unprotected waters. More particularly the invention relates to a mooring system which combines a submerged buoyant mooring element anchored to the sea bed by catenary lines and a vessel provided with hoisting apparatus for raising the mooring element into engagement with a mooring recess in the bottom of the vessel hull.

Background Art

In recent years, numbers of undersea oil and gas fields have been developed in offshore areas that are subject to extreme weather conditions. Oil or gas is typically delivered from a wellhead on the sea floor to a semi-permanently moored converted tanker or to a special purpose vessel known as a floating storage and off-loading (FSO) vessel or a floating production storage and off-loading (FPSO) vessel. These vessels are designed to remain on station permanently, unless oncoming severe storm or ice floe conditions threaten damage to or loss of the vessel. In such an event, the vessel is unmoored and sails or is towed away. Upon passing of the storm or ice floe condition, the vessel returns and is again moored above the wellhead.

A typical mooring system, such as for example described in U.S. Pat. Nos. 4,604,961 and 4,892,495, includes a buoyant mooring element that is connected to the wellhead by a flexible pipe and to the sea floor by a number of angularly spaced catenary lines. The system is arranged so that the weight of the portions of the catenary lines that are not resting on the sea bottom counteracts the buoyancy of the mooring element to maintain it normally at a predetermined submerged depth, called the stowed position, when no vessel is moored to it. This assures that the mooring element will not be a navigation hazard or be damaged by a collision.

Mooring is accomplished by pulling the submerged mooring element up to the vessel and securing it by mechanical means to a rotary turret mounted in a recess or well in the bottom of the vessel. This operation can take place only in a relatively low sea state. While the FSO or the FPSO vessel is away, the well is usually shut in; therefore the time required to wait for the sea state to subside after the storm has passed is additional lost production time from the field.

Another problem with the present technology is the possibility of impact damage to the vessel or the mooring element during mooring. A relatively long time is required to secure the mooring element to the turret after the hoist line has brought the mooring element close to the vessel bottom; during this time a number of rolling and pitching cycles of the vessel may take place in even a moderate sea state, and these movements can result in multiple collisions between the vessel and the mooring element.

Unmooring is accomplished by releasing structural connectors under load. This procedure has an inherent risk of structural deformation and damage to the mooring connectors during disconnect. Damage to the mechanical mooring components typically results in weeks of downtime, entailing costly oil field production shutdowns.

SUMMARY OF THE INVENTION

An object of the present invention is to provide an improved mooring system of the above-described type that provides rapid and secure engagement of a buoyant mooring element with a mooring recess in the bottom of a vessel.

Another object of the invention is to provide an improved mooring system that permits release of all structural connectors prior to initiating the unmooring procedure.

Still another object of the invention is to provide a mooring element arrangement that reduces the likelihood of impact damage during the mooring procedure.

A further object of the invention is to provide a mooring system that provides dry access to the mooring element after it has been secured to the vessel.

Yet another object of the invention is to provide an improved mooring system of the type described that permits mooring a vessel in higher sea states than with conventional systems.

The above and other objects are achieved by an ocean mooring system including a vessel having a hull with an annular mooring recess in the bottom of the hull;

a buoyant mooring element having an upper part that is engageable with the mooring recess in the bottom of the hull;

a plurality of lines connecting the mooring element to the ocean floor, the weight of the lines relative to the buoyancy of the mooring element being such that the mooring element assumes an equilibrium position at a preselected depth below the bottom of the hull; and means for hoisting the mooring element from the preselected depth to engagement with the mooring recess in the bottom of the hull, wherein the system further comprises:

means for rapidly drawing seawater into the hull through an intake opening located within the mooring recess so as to reduce the downward hydrostatic pressure acting on the upper part of the mooring element as it comes into engagement with the mooring recess.

Preferably the means for rapidly drawing seawater into the hull provides a flow rate sufficient to produce a substantial net positive buoyancy condition of the combined lines and mooring element as the mooring element engages the submerged bottom portion of the hull.

The means for rapidly drawing seawater from the mooring recess into the hull preferably includes a pump, a first conduit connecting an inlet of the pump to an intake opening within the mooring recess and a second conduit connecting an outlet of the pump to at least one discharge opening remote from the mooring recess. This pump advantageously may also function as a bow thruster pump, and the at least one discharge opening may comprise two underwater openings on opposite sides of the hull near the bow. The second conduit may then include means for selectively directing the flow from the pump to one discharge opening or the other.

The means for rapidly drawing seawater from the mooring recess into the hull may also, or alternatively, include a hermetic chamber inside the hull, the chamber having a valve opening to the mooring recess in the bottom of the hull and means for creating a vacuum in the chamber. The vacuum creating means may comprise a vacuum pump, or it may comprise a steam supply line, a vent line, and a cold water supply line, with respective valves for opening the steam supply and vent lines until substantially all air in the chamber has been replaced by steam, and a valve for opening the cold water supply line to condense the steam after the first two valves have been shut.

The means for rapidly drawing seawater from the mooring recess may further include an empty hold in the hull and a valve opening to the mooring recess to permit water to drain into the hold.

The upper part of the buoyant element preferably includes at least one resilient annular member concentric with the vertical axis of the mooring element, the resilient annular member making initial contact with the mooring recess to cushion any impact between the mooring element and the vessel. Preferably the resilient annular member makes a circle of sealing contact with the bottom of the hull so that the means for rapidly drawing seawater into the hull can pump out the region between the bottom of the hull and the upper part of the mooring element inside the circle of sealing contact.

The buoyant mooring element may further include a lower part and means for mounting the upper part on the lower part for rotation about a vertical axis of the element, with the lines connecting the mooring element to the ocean floor being attached to the lower part so that the upper part and the vessel can swivel about the lower part when the upper part is engaged with the mooring recess in the bottom of the hull.

The upper part preferably includes two concentric resilient annular members that make circles of sealing contact at locations of the mooring recess that are respectively radially inside and radially outside the location of the pump intake and/or the location of the valve opening from the hermetic vacuum chamber, so that the downward pressure on the upper part of the mooring element between the concentric circles of sealing contact can be reduced to a level possibly as low as the vacuum in the hermetic chamber.

The above and other features and advantages of the mooring system of the invention are described in detail below in connection with the drawings.

DETAILED DESCRIPTION OF THE PREFERRED EMBODIMENTS

Figure 1:
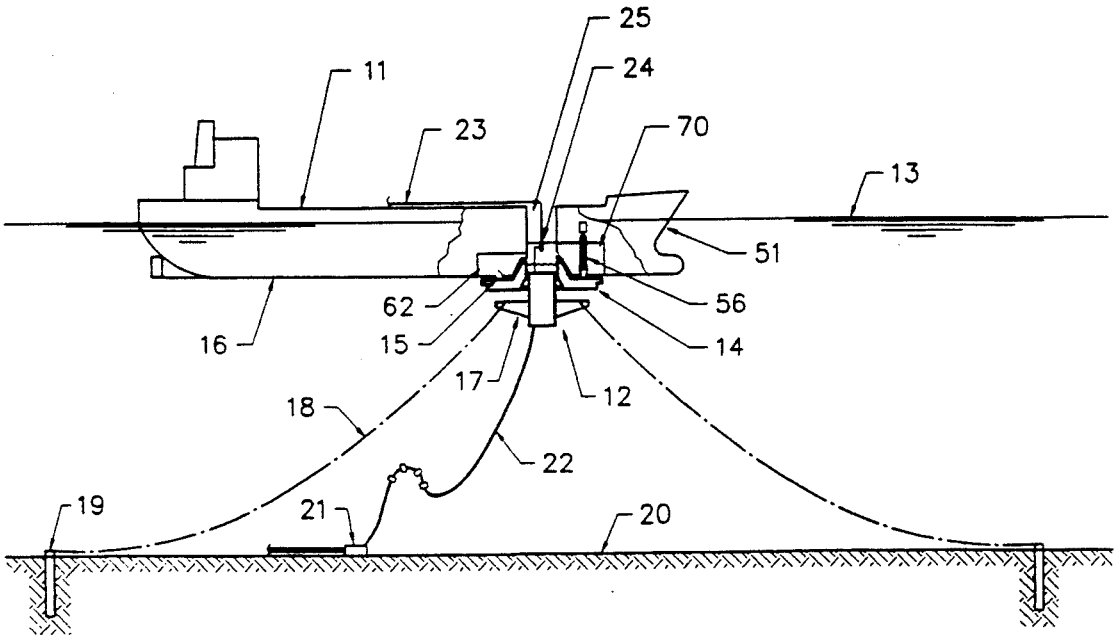
FIG. 1 is a side elevation view of a vessel partially cut away to show a mooring element engaged with a mooring recess in the hull of the vessel in a mooring system according to the FIG. 2 is a side elevational view of the mooring element without the vessel, the mooring element being maintained submerged at a preselected depth in an equilibrium condition.

A first embodiment of the invention is shown in FIGS. 1–5. In FIG. 1, a vessel, such as a tanker 11, is moored to a buoyant mooring element 12 that is submerged below the ocean surface 13. The mooring element 12 has an upper part 14 that is engaged with a mooring recess 15 in the bottom of the hull 16 of the vessel. A lower part 17 of the mooring element is connected by catenary anchor lines 18 to stake piles 19 driven into the ocean bottom 20. The stake piles, only two of which are shown, are typically spaced in a circular array around a wellhead 21 that is also connected, by a flexible hose or pipe 22, to the lower part of the buoyant mooring element to deliver oil or gas produced by the well to a conventional onboard piping system 23 through a fluid swivel 24 located in a vertical well 25 extending through the hull.

Figure 2:
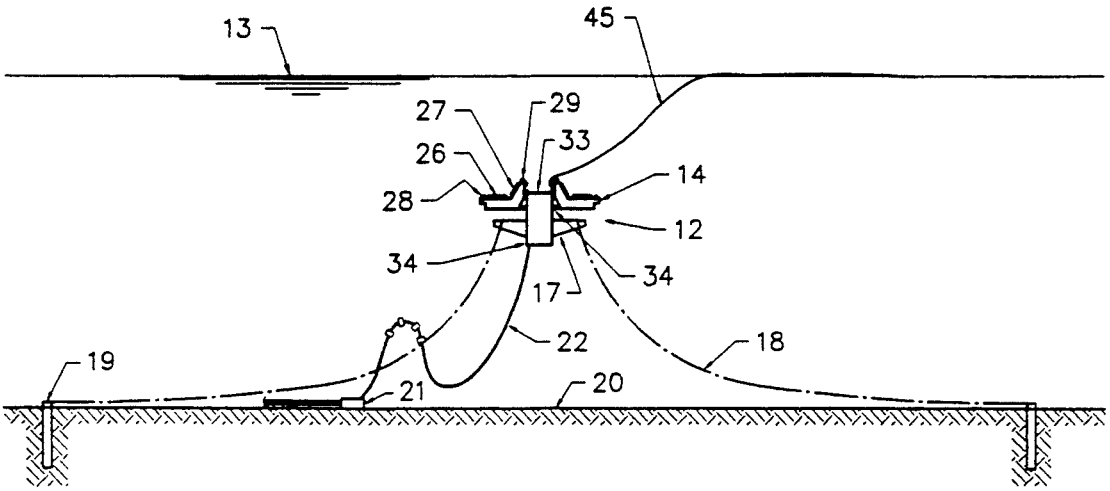
Figure 3:
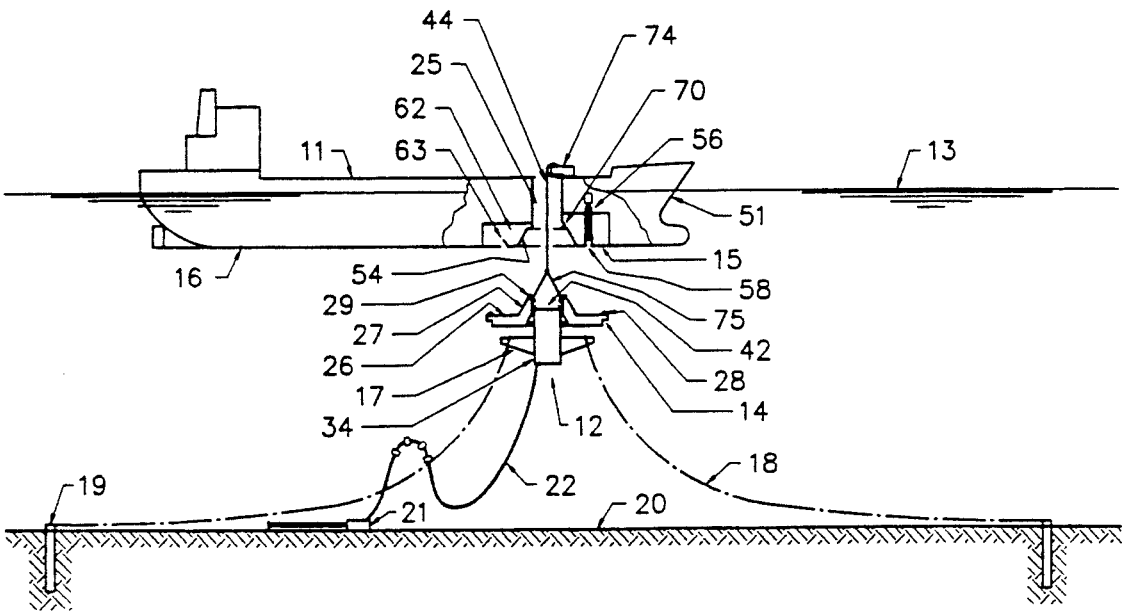
FIG. 3 is a side elevational view of the vessel of FIG. 1 partially cut away to show the mooring element being hoisted from the preselected equilibrium depth towards engagement with the mooring recess in the hull.

FIGS. 2 and 3 illustrate steps in the mooring procedure that will be discussed after a detailed description of the construction of the buoyant mooring element and the shipboard components of the mooring system.

The Buoyant Mooring Element

Figure 4:
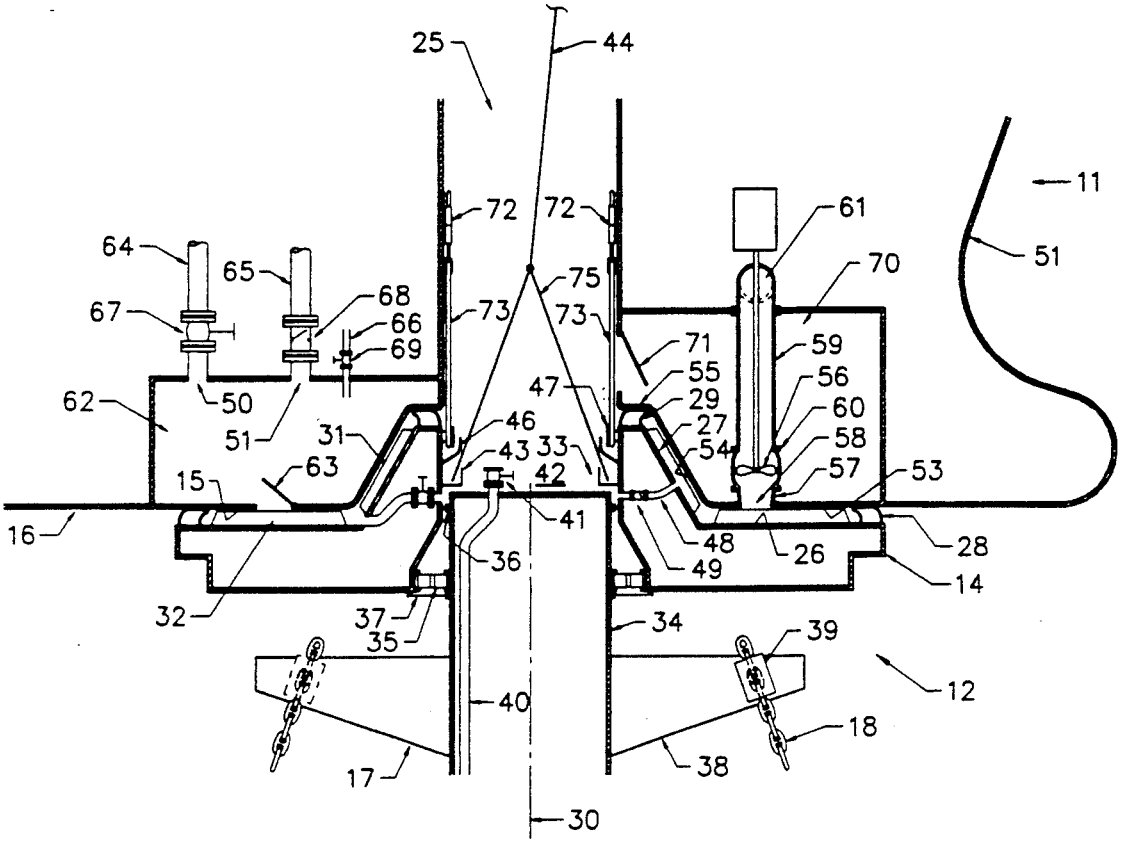
FIG. 4 is an enlarged partial side elevational view in cross section of the vessel and mooring element of FIG. 1 showing details of construction of the mooring system.
Figure 5:
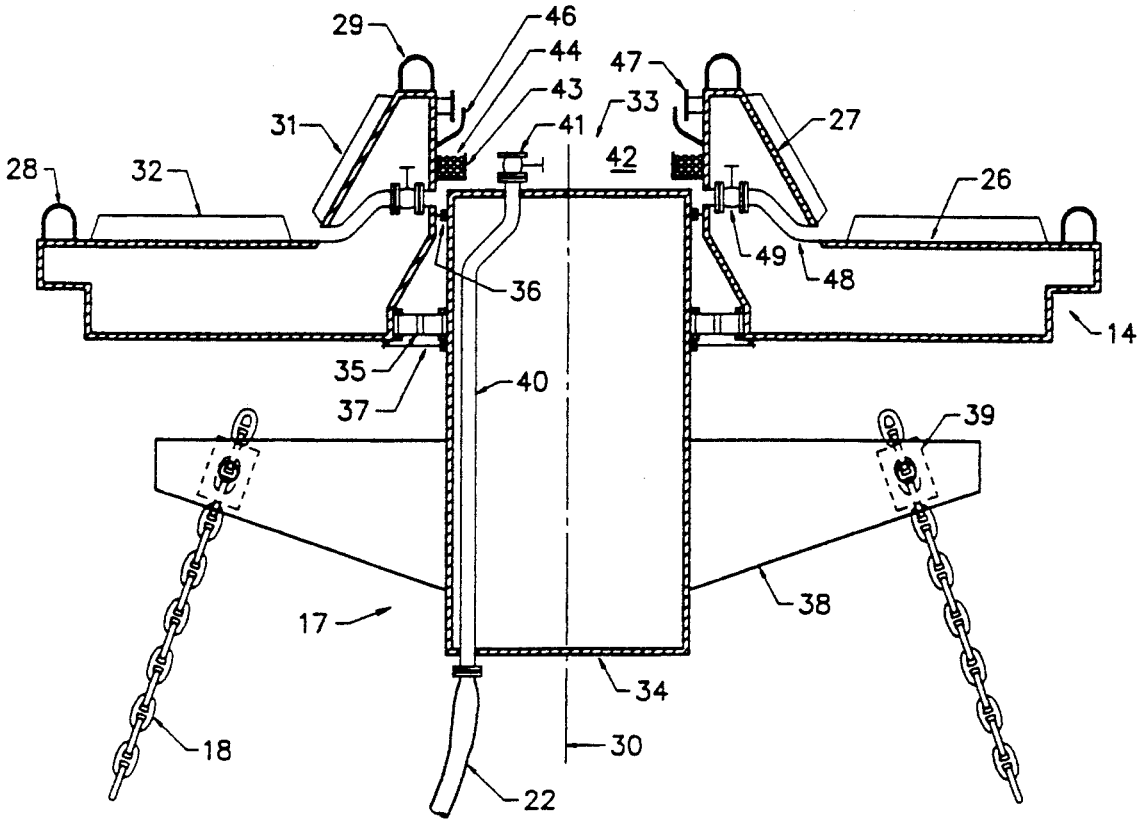
FIG. 5 is a still further enlarged side elevational view of the buoyant mooring element of FIG. 1.

FIG. 4 shows, on an enlarged scale the construction details of the mooring element 12 in engagement with the mooring recess 15 in the bottom of the hull and the associated parts of the mooring system that are contained in the vessel. FIG. 5 shows, on an even more enlarged scale, the construction of the first embodiment of the mooring element. With reference to these figures, the upper part 14 of the first embodiment of the buoyant mooring element is essentially a disk-shaped hollow tank having a flat annular upper deck 26 surrounding a raised frusto-conical center section 27.

An outer first ring-shaped resilient member 28, shown as an internally pressurized elastomeric tube, is secured to the periphery of the upper deck 26. An inner second resilient member 29 of identical construction is secured to the top of the frusto-conical center section 27. The first and second ring-shaped resilient members are coaxial with a vertical axis of the mooring element, the axis being indicated by a dot-dash line 30.

As will be explained later in connection with the description of the mooring procedure, these resilient members 28 and 29 serve both to cushion the impact between the mooring element and the mooring recess in the bottom of the hull of the vessel during mooring and to seal the space between the annular upper deck and center section of the mooring element and the corresponding portion of the bottom of the vessel hull that defines the mooring recess, when the upper part of the mooring element is engaged with the mooring recess. Angularly spaced radial ribs 31 and 32 act as stops to limit the compression of the resilient members when the mooring element engages the mooring recess (see FIG. 4).

The second resilient member 29 surrounds a vertical passage 33 extending through the upper part 14. The lower part 17 of the mooring element includes a watertight cylindrical tank 34 having an upper end disposed in the lower part of passage 33. A combination radial and thrust bearing 35 supports the tank 34 in the passage 33 for rotation with respect to the upper part 14 about the vertical axis 30. A first rotary seal 36 between the outer circumference of the tank and the wall of the passage above the bearing and a similar second rotary seal 37 below the bearing protect the bearing from seawater.

A structure 38 extending radially outward from the lower portion of the cylindrical tank 34 carries appropriate means 39 for securing the upper ends of the catenary anchor lines 18 to the lower part 17 of the buoyant mooring element. As a result, the lower part 17 maintains a fixed orientation relative to the ocean bottom, whereas the upper part 14 is maintained in a fixed orientation relative to the vessel 1 when the vessel 1 is secured to the mooring element. When the vessel 1 weathervanes in response to current, wind, and waves the two parts 14 and 17 of the mooring element can rotate relative to one another through the bearing 35.

To complete the connection from the flexible product supply hose 22 to the onboard piping system 23 shown in FIG. 1, a pipe 40 extends through the tank 34 and terminates in a shutoff valve 41 mounted on top of the tank and located in a protective well 42 formed by the upper end of passage 33. Also located in this well 42 is an annular tray 43 that holds a coiled hoisting cable 44 having a buoyant retrieval line 45 (see FIG. 2) attached to its free end. When the mooring element submerges to its stowed position, the buoyant retrieval line pays out from the tray. A guide shield 46 prevents the line from snagging on bitts 47 (only two shown) that are spaced circumferentially around the upper end of the vertical passage 33. Also spaced circumferentially around the vertical passage are several drain pipes 48 with remotely actuatable valves 49 (two of which are shown) that selectively connect the protective well 34 with the deck 26 of the upper part 14 of the mooring element for a purpose that will be described in connection with the mooring procedure.

Shipboard Components of the Mooring System

The mooring system of the present invention includes several novel components on board the vessel. These will now be described, with particular reference to FIG. 4, which is a side elevation view in cross section of part of the vessel 11 near the bow 51, showing the region of the mooring recess 15 with attached mooring element 12.

The term "mooring recess," as used in the specification and claims, encompasses an area of the bottom of the hull 16 that is contacted by the upper part of the mooring element, whether or not any portion of this area is in fact "recessed" with respect to the bottom surface of the hull. Thus, in the embodiment of FIG. 4, mooring recess 15 extends radially outward from the axis of the vertical well 25 to the contact circle of the outer first resilient member 28. It includes a flat annular area 53 of the hull bottom opposite to the flat upper deck 26 of the upper part of the mooring element, as well as an inwardly tapered portion 54 that mates with the frusto-conical center section 27 of the mooring element and that terminates in an inner flat annular portion 55 which makes sealing contact with the inner second resilient member 29.

As described in the summary of the invention, the mooring system comprises means for rapidly drawing seawater into the hull through an intake opening located within the mooring recess so as to reduce the downward hydrostatic pressure acting on the upper part of the mooring element as it comes into engagement with the mooring recess. In FIG. 4, the vessel 11 contains three such means. Any one of them, however, can be used by itself or in combination with one of the other two.

The first such means is a high capacity pump 56 having an intake conduit or suction pipe 57 with an intake opening 58 located in the mooring recess area between the coaxial sealing contact circles of the outer and inner resilient members 28 and 29. A second conduit 59 connects the outlet 60 of the pump to at least one discharge opening 61 that is remote from the mooring recess. Preferably, the pump 56 may also be part of a bow thruster system having two discharge openings on opposite sides of the bow (only the port side opening 61 is shown) and means (not shown) for selectively proportioning the flow from the pump between the two discharge openings to help maneuver the vessel.

The second means shown in FIG. 4 for rapidly drawing seawater into the hull from the mooring recess is a hermetic chamber or vacuum tank 62 inside the hull, the chamber 62 having a valve 63 also opening to the mooring recess area between the outer and inner sealing contact circles of resilient members 28 and 29 and means for creating a vacuum in the chamber. The vacuum creating means may comprise a conventional vacuum pump (not shown). In the embodiment of FIG. 4, the means for creating a vacuum in the chamber 62 comprises a steam supply line 64, a vent line 65, and a cold water supply line 66, with respective valves 67 and 68 for opening the steam supply and vent lines until substantially all air in the chamber has been replaced by steam, and a valve 69 for opening the cold water supply line to condense the steam after the first two valves have been shut.

The third means shown in FIG. 4 for rapidly drawing seawater from the mooring recess includes an empty hold 70 in the hull and a valve 71 opening to the mooring recess to permit water to drain into the hold. In this case, the valve 71 is located in the well 25 above the inner annular portion 55 of the mooring recess so that most of the water in the access well can drain by gravity into the empty hold 70.

FIG. 4 also shows one possible arrangement for physically connecting the mooring element 12 to the vessel 11. This arrangement includes a number of linear actuators, such as hydraulic cylinders 72, mounted in spaced relation around the inner circumference of the well 25. A mooring rope 73 hangs from a movable part of each hydraulic cylinder and has a hook or eye splice at its lower end that engages one of the bitts 47 that are spaced around the upper end of the vertical well 25 in the upper part 14 of the mooring element. The hook or eye splice can be placed on the bitt when the hydraulic then be tightened by actuating the hydraulic cylinder to an upstroke position. The hydraulic cylinders are preferably of the type that can be locked in the upstroked position to maintain the mooring ropes 72 in a stressed condition. The stress level in each mooring rope is selected such that the sum of the tension forces in all the mooring ropes substantially exceeds the maximum expected vertical separating force between the mooring element and the vessel, thereby preventing relative movement between the two.

Operation of the Mooring System

The operation of the mooring system of the invention will now be described with particular reference to FIGS. 2 and 3.

FIG. 2 shows the mooring element 12 in the stowed position or neutral equilibrium condition when the vessel 11 is not moored to the buoy. The mooring element 12 rests at a depth relative to sea level 13 such that the net buoyancy of the mooring element 12 exactly equals the submerged weight of the anchor lines 18 and the flexible hose 22. If the element 12 descends below the equilibrium level suspended sections of the anchor lines 18 come to rest on the sea bed 20, thereby reducing the weight carried by the buoyant element 12 and producing a net positive buoyancy. If the element rises above the equilibrium level, more of the anchor lines are lifted from the bottom, resulting in a net negative buoyancy. The mooring element is manufactured with designed excess buoyancy, and the equilibrium level is achieved at initial deployment by adding ballast.

FIG. 3 shows the initial steps of mooring the vessel 11 to the mooring element 12. When the vessel 11 arrives, it picks up the buoyant retrieval line 45, which is passed through the bottom of the well 25 and secured to a winch 74. The retrieval line 45 is hauled in, followed by the hoisting cable 44, which in the preferred embodiment is attached to the inner circumference of the protective well 42 in the upper part 14 of the mooring element through a number of angularly spaced tail ropes 75 such that the tail ropes will assist in centering the mooring element 12 in the well 25 when the upper part 14 is brought into close proximity to the bottom of the vessel 11.

Meanwhile, the pump 56 is taking suction through the intake opening 58, and if the pump is part of a bow thruster system, the discharge flow from the pump assists in controlling the position of the bow of the vessel 11 over the mooring element by providing lateral thrust upon demand.

The winch 74 is preferably of the constant tension type, reeling the hoisting cable in whenever the tension is low and paying it out when the tension exceeds a preset level, thereby avoiding overstressing the hoisting cable 44 during the mooring process. As the winch 74 lifts the mooring element up to the bottom of the vessel 11, the tail ropes 75 reach the well 25. The tail rope assembly tends to center the mooring element 12 with respect to the well 25. The winch 74 continues to reel in the hoisting cable until the raised frusto-conical center section 27 of the mooring element enters the inwardly tapered portion 54, automatically centering the mooring element 12 in the mooring recess 15.

When the resilient members 28 and 29 contact the bottom of the vessel 11, as shown in FIG. 4, the intake opening 58 of the pump 56, the vacuum chamber intake valve 62, and the valve 71 opening to the empty hold 70 are all isolated from the sea by the sealing contact of the resilient members and, in the case of valve 71, also by the rotary seals 36 and 37 above and below the support bearing for the lower part 17 of the mooring element.

As the pump 56 continues to take water from the volume isolated from the sea by the resilient members 28 and 29, the pump suction pressure reaches the minimum net suction pressure head and starts cavitation. In the event that the seals between the resilient members 28, 29 and the mooring recess are not completely water tight, the pump 56 will continue to remove the water leaking into this isolated volume.

The water in the well 25 also will be pumped out by the pump 56 via the pipes 40 connecting the bottom of the protective well 42 in the mooring element 12 to the volume isolated by the sealing contacts of the resilient members 28 and 29. The valve 41 in the connecting pipe 40 permits the passage of liquids but shuts in the presence of air, so that the volume isolated by the members 28, 29 will not be vented to the atmosphere. The pressure in this space will then become substantially equal to the below atmospheric cavitation pressure of the pump 56.

Just prior to contact by the resilient members 28 and 29 with the mooring recess, the net buoyancy of the mooring element and suspended anchor lines and hose is negative by the weight of additional anchor lines and hose lifted from the sea bottom as the mooring element is raised from the neutral buoyancy depth to the keel depth of the vessel. The disk-shaped or pancake design of the upper part 14 of the mooring element creates a large horizontal surface area relative to the volume, and hence relative to the buoyancy of the upper part. The relation between horizontal surface area, buoyancy of the element, and suspended weight of anchor lines and supply hose at the vessel keel depth is predetermined so that, as soon as the resilient members 28 and 29 make contact with the mooring recess, the rapid reduction of the hydrostatic pressure on the annular upper deck 26, the frusto-conical center section 27, and the top of the cylindrical tank 34 by action of the pump 56, shifts the net buoyancy of the mooring element system from negative to positive, due to the large decrease in hydrostatic force acting on the top of the mooring element.

In this condition the mooring element 12 is securely pressed against the hull of the vessel 11 and, absent leakage past the resilient member 28 or the rotary seals 36 and 37, will remain so indefinitely. As a safety precaution, however, it is desirable to secure the upper part 14 of the mooring element physically to the vessel, for example, by using the previously described hydraulic cylinders 72 and mooring ropes 73.

If the vessel 11 is not equipped with a suitable pump 56, the valve 63 to the vacuum tank 62, the valve 71 to the empty hold 70, or both, will be opened when the resilient members 28 and 29 contact the bottom of the vessel 11, thereby draining the well 25 into the hold 70 and lowering the hydrostatic pressure in the volume isolated by the members 28 and 29.

Even if the seals leak, the reduced hydrostatic pressure on the top of the mooring element 12 will be maintained until the vacuum chamber 62 is filled with sea water. This will allow sufficient time before the vacuum chamber 62 fills with water for the vessel's crew to make a connection with the mooring ropes 73, thereby securely mooring the vessel 11 to the mooring element 12.

The vacuum chamber 62 may be evacuated prior to mooring by a normal vacuum pump (not shown) or may be conveniently evacuated using the auxiliary steam supply that tankers usually are equipped with for powering the vessel's cargo pumps. The vacuum chamber 62 is evacuated by securing the valve 63 in closed position, removing all water from the chamber by a drain pump (not shown), opening the steam valve 67 causing the chamber 62 to be filled with steam through the pipe 64, raising the pressure in the chamber 62 and forcing a mixture of steam and air out the vent 65 through the check valve 68. This is continued until all air in the chamber 62 has been expelled through the vent 65. Vacuum is subsequently produced by closing the valve 67 and opening the valve 69 which admits cold water into the chamber 62. This lowers the pressure in chamber 62, causing the check valve 68 to shut. Rapid condensation of the steam lowers the pressure in the chamber 62 to the vapor pressure of the water, which for cold water is very near absolute vacuum. Opening of the valve 63 admits more cold sea water, insuring a low vapor pressure and thereby low pressure in the chamber 62 during the mooring procedure.

In some cases the vessel may be equipped with only the valve 71 connecting the well 25 to an empty hold 70. In this situation, the valve 71 will be opened when the resilient members 28 and 29 contact the bottom of the vessel 11. This will drain most of the seawater in the well 25 into the hold 70 and thus, via the connecting pipes 40, will lower the hydrostatic pressure in the volume isolated by the resilient members 28 and 29. If the seals leak, the reduced hydrostatic pressure at the top of the mooring element will be maintained until the hold 70 is filled with sea water. As in the case of the vacuum chamber, sufficient time will be available before the hold 70 fills with water for the vessel's crew to make a structural mooring connection with the mooring ropes 72. Since the valve 71 is necessarily located above the flat annular area 53, the well 42 in the upper part of the mooring element can be emptied by a portable or built in bilge pump (not shown).

Alternative embodiments

FIG. 6 shows a second embodiment of a mooring element 76 in which the upper part 77 is furnished with an exterior downward projecting skirt 78 which permits the trapping of air. This embodiment of the mooring element also is equipped with two bearings between the upper part 77 and the lower part 79: a radial bearing 80 which is capable of transmitting only forces perpendicular to the vertical axis 81 of the mooring element 76 and a thrust bearing 82 capable of transmitting only forces parallel to the axis of rotation 81. This arrangement with separate radial and thrust bearings 80 and 82 is not limited to the mooring element embodiment shown in FIG. 6 but may be substituted for the combined radial and thrust bearing 35 in the other illustrated embodiments.

After completing the mooring operation, a compressed air supply line 83 aboard vessel 11 is connected to a coupling 84 on the mooring element 76 to supply compressed air through piping 85 to the air trap space 86, thereby forcing the sea water level in the trap down to the lip 87 of the skirt. Personnel may then access the trap space 86 from the vessel 11 by means of an air lock (not shown) in the tank 34 of the lower part 79 to perform inspections of and maintenance on the anchor lines 18, the lower rotary seal 37, the radial bearing 80, and the thrust bearing 82. The bottom of the upper part 77 is equipped with strongpoints 88 for support of maintenance equipment to lift the anchor lines 18 and to assist in the maintenance of bearings 80 and 82.

Figure 6A:
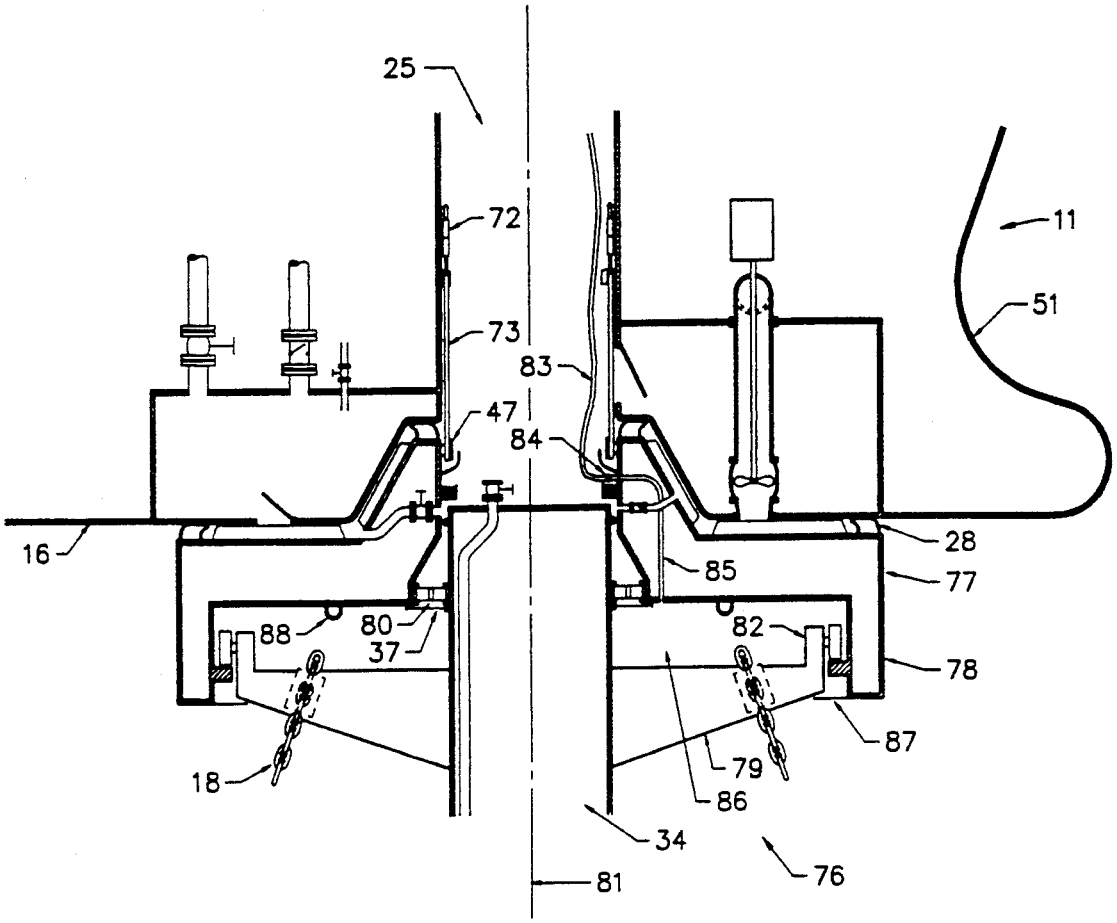
FIG. 6*a* is an enlarged partial side elevational view in cross section, similar to FIG. 4, of the vessel and a second embodiment of the buoyant mooring element.
Figure 6B:
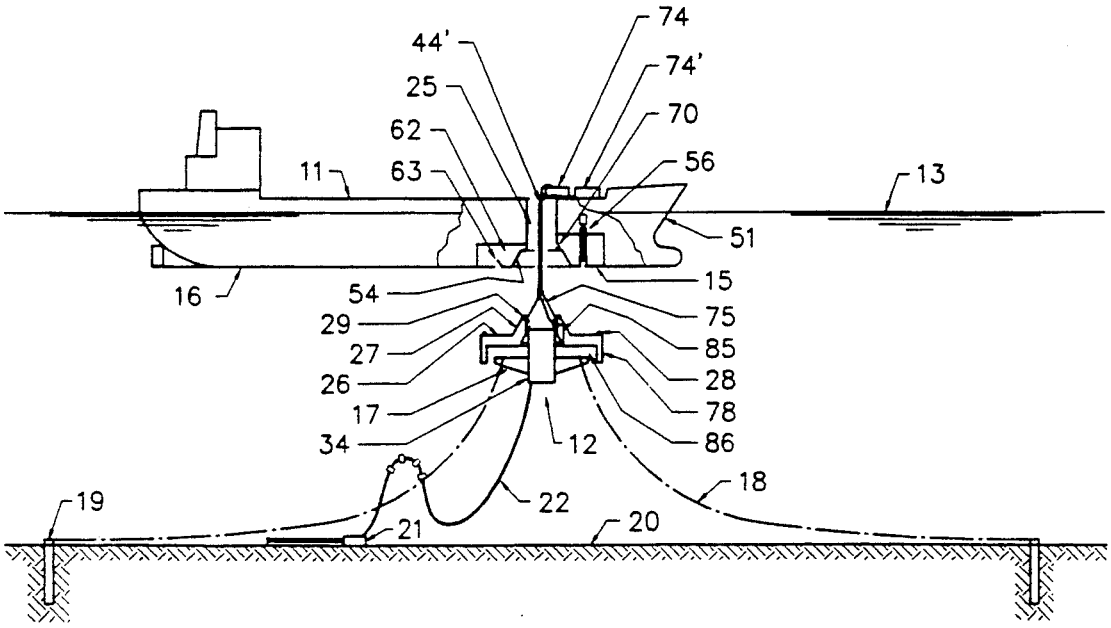
FIG. 6*b* is a side elevational view similar to FIG. 3 showing the mooring element of FIG. 6*a* being hoisted by a flexible pipe lifting cable.

The embodiment of FIG. 6*a* also permits an alternative arrangement in which a lower end of the compressed air line 83 is permanently attached to the piping 85 and an upper end is attached to the buoyant retrieval line so that the air line 83 can be connected to a source of compressed air on the vessel when the hoisting cable 44 is retrieved. In fact, as shown in FIG. 6*b*, the hoisting cable itself may be a strong flexible pipe 44' capable of delivering compressed air to the trap space 86. In this case, the lower end of the lifting pipe 44' is permanently connected to the piping 85, and the tail ropes 75 are attached near the lower end of the pipe 44' to take the lifting load, so that the connection from flexible lifting pipe 44' to piping 85 is not stressed. The upper end of lifting pipe 44' is connected, through a conventional rotary seal on the drum of winch 74, to a compressed air supply source 88'.

With this arrangement, compressed air can be injected into the trap space 86 before or during raising of the mooring element, thereby increasing the buoyancy of the mooring element and correspondingly decreasing the tension in the hoisting cable. Increasing the buoyancy of the mooring element in this way during the raising operation results in at least two advantages. First, the required hoisting capacity of the winch and tensile strength of the lifting line can be substantially reduced. Second, the capacity of the means for rapidly withdrawing seawater into the hull from the mooring recess as the mooring element comes into contact with the mooring recess likewise can be reduced, since there is a smaller net negative buoyancy to overcome in order to press the mooring element against the hull of the vessel.

Figure 7:
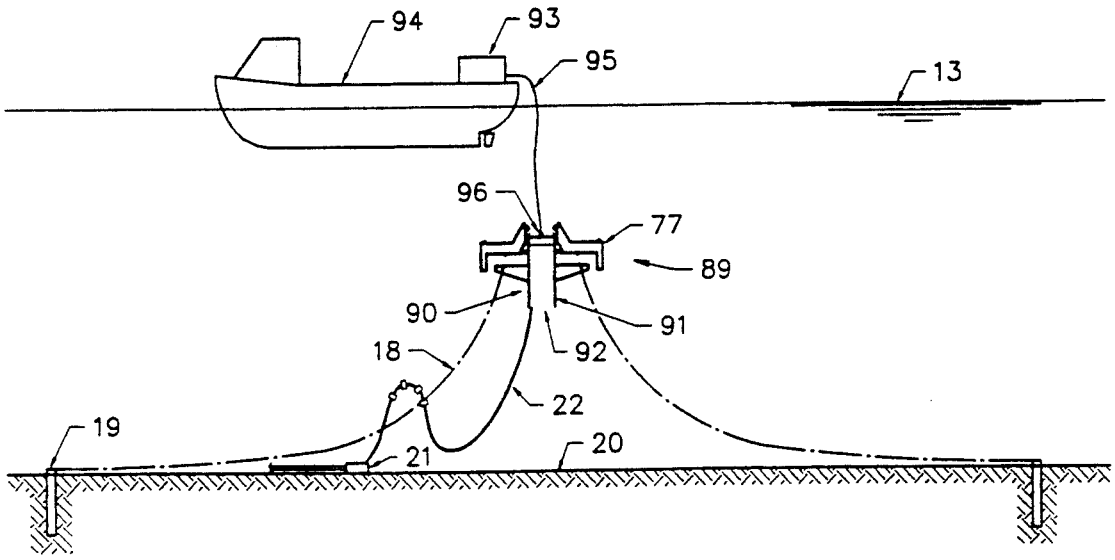
FIG. 7 is a side elevational view of a service vessel with a compressed air line connected to a downward facing air trap of the alternative buoyant mooring element of FIG. 6, the mooring element being at the preselected equilibrium depth.
Figure 8:
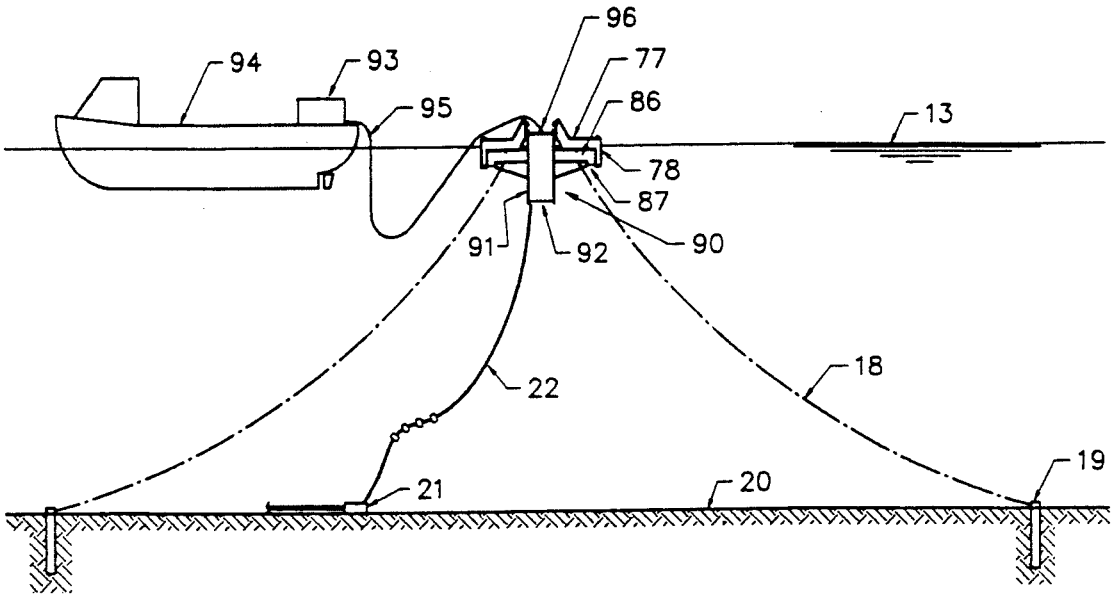
FIG. 8 is a side elevational view similar to FIG. 7 but with the mooring element raised by compressed air introduced into the air trap and floating on the surface of the ocean to permit access for maintenance.

FIGS. 7 and 8 illustrate the construction and operation of a third embodiment of a mooring element 89 having an upper part 77 identical to that of the second embodiment and a lower part 90 in which the cylindrical tank 91 has an open bottom 92. The mooring element 89 is designed to have a positive metacentric height under any partially filled condition of the cylindrical tank 91 necessary to maintain the mooring element at a desired equilibrium depth below sea level, as shown in FIG. 7. The volume of the cylindrical tank 91 is predetermined to provide sufficient buoyancy so that the mooring element 89 will float on the ocean surface 13 when the tank 91 is completely filled with air.

The mooring element 89 can be raised to the surface by connecting an air compressor 93 aboard a maintenance vessel 94 through a hose 95 to a coupler 96 on top of the cylindrical tank 91, using a diver or a remote operations vehicle (not shown). Air introduced into the top of the tank through hose 95 will displace water in the tank, increasing the buoyancy and causing the mooring element to rise to the surface, as shown in FIG. 8.

By continuing to pump air into the tank 91 after the mooring element has reached the surface, the excess air will escape out the open bottom 92 and bubble up into the air trap space 86 until the internal water level in the air trap is lowered to the bottom of the skirt 78, providing additional mooring element buoyancy. As long as the mooring element is floating on the surface, introducing air into the air trap space 86 will not cause the metacentric height to become negative, and the mooring element will float securely on the surface. Then the maintenance vessel 49 can perform all required maintenance. Personnel access to the trap space 86 is through an air lock (not shown).

After necessary maintenance and repair have been performed, the mooring element is returned to the stowed position by first letting out all air from the trap space 86 through a vent line (not shown), and then bleeding air out of the tank 91 through the compressor hose until the mooring element sinks to its preselected equilibrium level. A diver can then remove the air compressor hose 95 from the coupler 96, or the air hose may be left attached to the mooring element and disconnected at the compressor 93, with a small marker buoy being attached to the free end of the hose to facilitate later retrieval.

Figure 9:
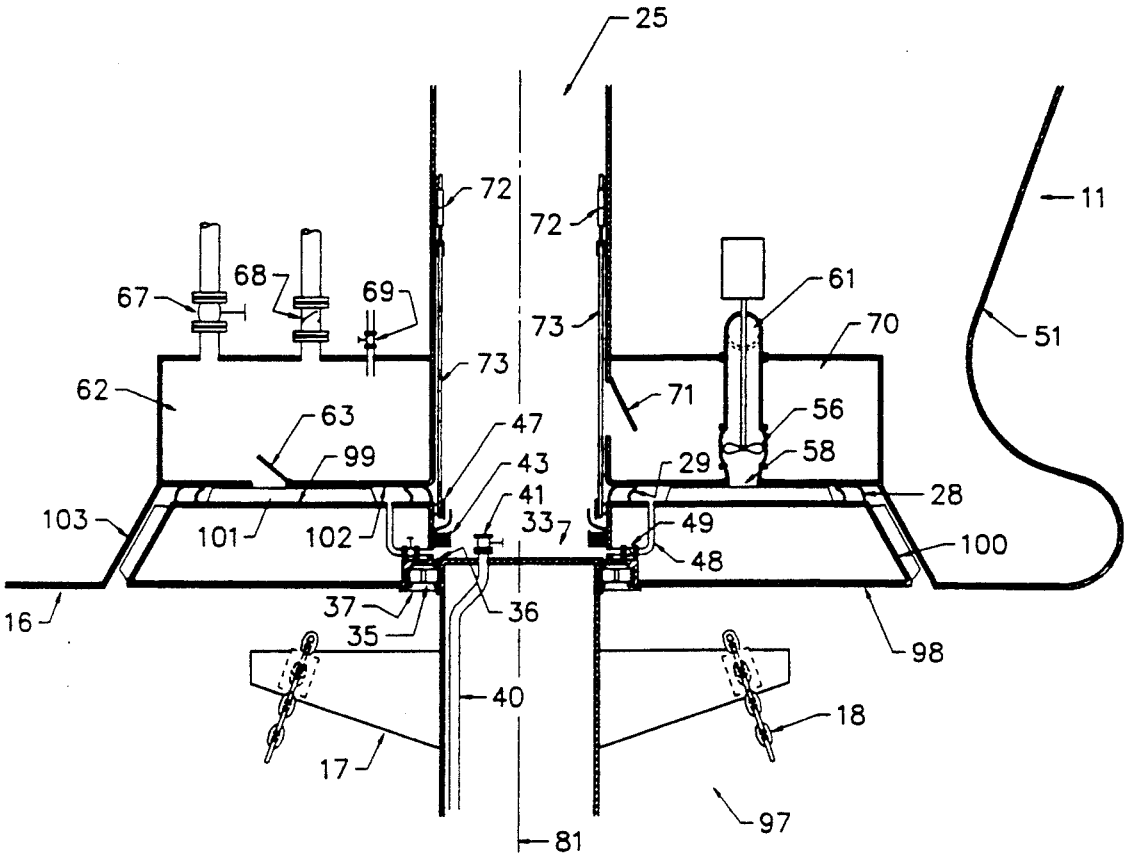
FIG. 9 is an enlarged partial side elevational view in cross section, similar to FIG. 4, of the vessel and a third embodiment of the buoyant mooring element.

FIG. 9 shows a fourth embodiment of the mooring system, in which a buoyant mooring element 97 has an upper part 98 with a completely flat annular upper deck 99 extending radially outward from the vertical central passage 33, without any raised frusto-conical center portion. Instead, the outer edge 100 of the disk-shaped upper part 98 is tapered inwardly from bottom to top. A mooring recess 1? 1 in the bottom of the hull of the vessel has a flat annular portion 102 and a tapered peripheral edge 103 that mate with the upper deck 99 and outer edge 100 of the upper part 98. All other elements of this embodiment are essentially the same as the corresponding elements in the first embodiment and have the same reference numerals.

As in the first embodiment, the tail ropes of the hoisting line help to center the mooring element 97 with respect to the vertical well 25 when hauling up the mooring element from its stowed position. When the mooring element 98 gets close to the bottom of the vessel 11 the two tapered surfaces 100 and 103 will provide the final guidance and centering of mooring element 97 in the mooring recess 101. When the resilient members 28 and 29 touch the flat annular portion 102 of the mooring recess, the mooring sequence explained in connection with FIG. 3 will be carried out. In this embodiment, any horizontal forces acting between the vessel 11 and the mooring element 97 will be transmitted through the surfaces 100 and 103.

Figure 10:
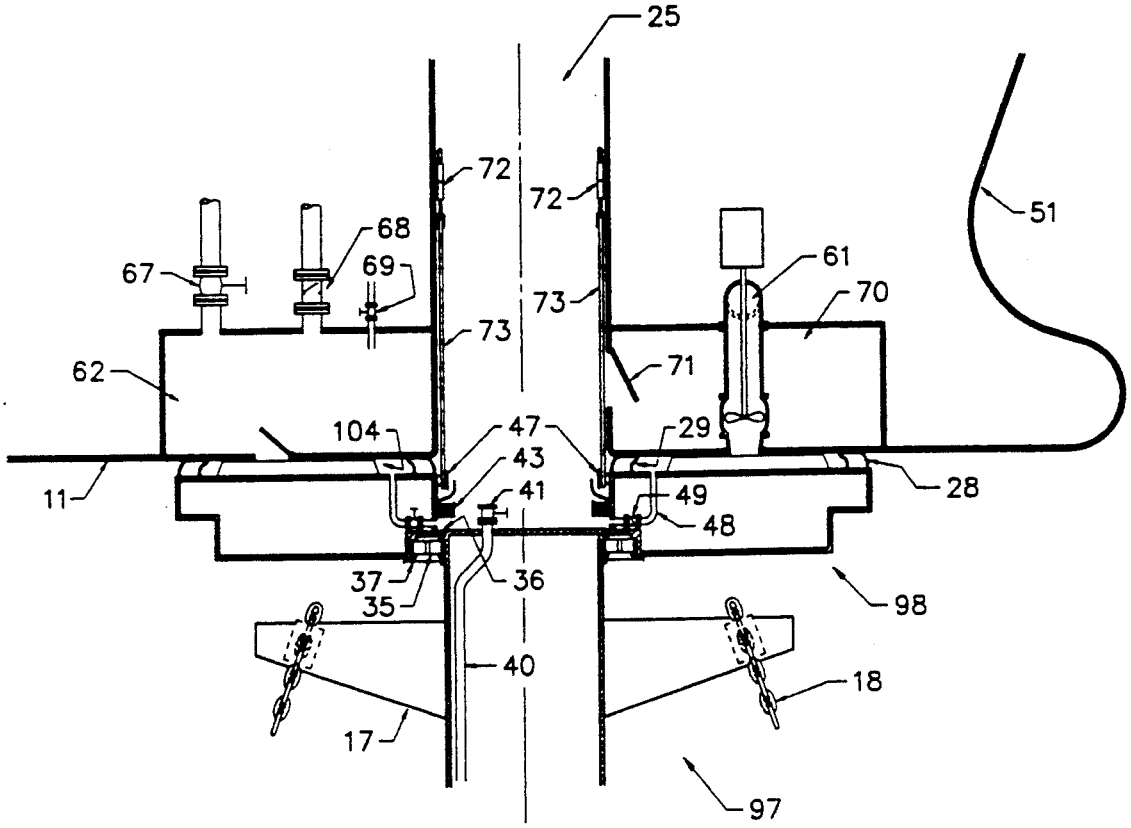
FIG. 10 is an enlarged partial side elevational view in cross section, similar to FIG. 4, of the vessel and a fourth embodiment of the buoyant mooring element.

FIG. 10 shows a fifth embodiment of the system, in which the mooring element is essentially the same (except for the shape of the outer edge of the upper part 98) as shown in FIG. 9, with the same reference numerals, but no modification is made to the shape of the bottom of the vessel 11. That is, a mooring recess 104 is composed of an annular area of the flat bottom of the hull that is within the contact circle of the outer resilient member 28.

The mooring procedure with this embodiment is exactly the same as with the preceding embodiments, as explained with reference to FIGS. 2, 3, and 4. The only difference is that the tailropes of the hoisting cable provide the only guidance for centering the mooring element with the vertical well 25.

Since there are no mating tapered surfaces to resist horizontal forces exerted between the vessel and the mooring element, it is particularly desirable with this embodiment to secure the mooring element physically to the vessel, as with the mooring ropes 73 described with reference to FIG. 4. When the mooring ropes have been stressed, a large compressive force exists between the mooring element 97 and the bottom of vessel 11, so that the friction between the mooring element 97 and the vessel 11 may be sufficient to prevent relative horizontal movement between them. In addition, other mooring lines (not shown) may be provided in the well 25 to resist relative horizontal movement between the mooring element 97 and the vessel 11.

The mooring system has been described in connection with FSO and FPSO vessels; however, the present invention is not limited to such vessels but applies to all vessels including tankers and military vessels for which a need exists to moor in conditions of severe sea states.

Several embodiments and variations of the invention have been described as illustrative examples. Various modifications may be effected within the spirit and scope of the invention. In the described embodiments (see FIG. 1, for example), the mooring recess has been described as being located near the bow of the vessel 11. It is not limited to this region but may be located at any position along the bottom of the vessel 11, including near the stern. At some locations for the mooring recess, notably near midships, the vessel will not automatically align with the environmental forces but would need power assist to do so. However, the present invention relating to a method of rapidly mooring the vessel in high sea states also applies to these cases.

The well 25 has been shown and described as extending vertically through the vessel 11; however, it is not required that the well 25 goes all the way to the deck of vessel 11. Indeed, the mooring system of the invention does not require any well 25 at all but only a narrow pipe leading to the deck of the moored vessel or a recess in the bottom of the hull permitting the retrieval and hauling in of the hoisting cable.

While the several means for rapidly reducing the hydrostatic pressure disclosed above have been described as providing temporary mooring of a vessel by net buoyant force of a submerged mooring element until a permanent physical connection between the vessel and the mooring element can be established, the invention also includes permanently mooring the vessel by maintaining the positive buoyancy of the mooring element system without resorting to any mechanical device.

The cross-sectional shape of the mooring element and of the vertical well in the vessel is preferably circular; however, the invention applies to any other shapes of the mooring element or vertical well meeting the technical requirements described herein.

The mooring method and embodiments of the present invention may be summarized as follows:

i. The invention relates to mooring a vessel to a submerged buoyant mooring element offshore. When the submerged mooring element is brought into contact with the bottom of the vessel, the hydrostatic pressure between the mooring element and the vessel is rapidly reduced, shifting the mooring element from a net negative to a net positive buoyancy condition and creating a compressive force between the mooring element and the hull of the vessel, thereby mooring the vessel. Because of the speed with which the hydrostatic pressure between the mooring element and the vessel may be reduced, which is on the order of one wave period, the vessel may be moored safely by this method in high sea states.

ii. The means for reducing the hydrostatic pressure between the mooring element and the vessel may be (a) the suction pump for the bow thruster with which many vessels are equipped, (b) an evacuated suction chamber in the vessel being opened to the sea above the mooring element during the mooring process, (c) an opening to an empty hold in the vessel during the mooring process reducing the hydrostatic pressure to the bottom level of the hold, (d) a combination of two or all of the above, or (e) specially provided high capacity pumps taking suction between the mooring element and the vessel.

iii. Any size vessel may be moored by the system; however, the system becomes more effective with increased draft of the vessel, and therefore the allowable sea state for mooring increases with vessel size.

iv. The system is suitable for all offshore, nearshore, and coastal waters, but is particularly suited for mooring vessels in ice infested arctic waters, because the mooring element is submerged when no vessel is present, extremely rapid connection is possible, and, more importantly, extremely rapid disconnection is possible.

v. Once the vessel is moored by the differential hydrostatic pressure with the resultant friction between the vessel hull and the mooring element, ordinary mechanical links such as hydraulically tensioned mooring ropes may be established between the mooring element and the vessel, securing the mooring in the event of loss of the hydrostatic pressure differential.

I claim:

1. An ocean mooring system including a vessel having a hull with an annular mooring recess in the bottom of the hull;

a buoyant mooring element having an upper part that is engageable with the mooring recess in the bottom of the hull;

a plurality of lines connecting the mooring element to the ocean floor, the weight of the lines relative to the buoyancy of the mooring element being such that the mooring element assumes an equilibrium position at a preselected depth below the bottom of the hull; and means for hoisting the mooring element from the preselected depth to engagement with the mooring recess in the bottom of the hull, wherein the system further comprises:

means for rapidly drawing seawater into the hull through an intake opening located within the mooring recess so as to reduce the downward hydrostatic pressure acting on the upper part of the mooring element as it comes into engagement with the mooring recess.

2. An ocean mooring system according to claim 1 wherein the means for rapidly drawing seawater into the hull provides a flow rate sufficient to produce a substantial net positive buoyancy condition of the combined lines and mooring element as the mooring element engages the submerged bottom portion of the hull.

3. An ocean mooring system according to claim 1 wherein the means for rapidly drawing seawater from the mooring recess into the hull includes a pump, a first conduit connecting an inlet of the pump to an intake opening within the mooring recess and a second conduit connecting an outlet of the pump to at least one discharge opening remote from the mooring recess.

4. An ocean mooring system according to claim 3 wherein the pump also functions as a bow thruster pump, and the at least one discharge opening comprises two underwater openings on opposite sides of the hull near the bow of the vessel.

5. An ocean mooring system according to claim 3 wherein the upper part comprises two concentric resilient annular members that make circles of sealing contact at locations of the mooring recess that are respectively radially inside and radially outside the location of the pump intake.

6. An ocean mooring system according to claim 1 wherein the means for rapidly drawing seawater from the mooring recess into the hull comprises a hermetic chamber inside the hull, the chamber having a valve opening to the mooring recess in the bottom of the hull and means for creating a vacuum in the chamber.

7. An ocean mooring system according to claim 6 wherein the vacuum creating means comprises a steam supply line, a vent line, and a cold water supply line, with respective valves for opening the steam supply and vent lines until substantially all air in the chamber has been replaced by steam, and a valve for opening the cold water supply line to condense the steam after the first two valves have been shut.

8. An ocean mooring system according to claim 6 wherein the upper part comprises two concentric resilient annular members that make circles of sealing contact at locations of the mooring recess that are respectively radially inside and radially outside the location of the valve opening from the hermetic vacuum chamber.

9. An ocean mooring system according to claim 1 wherein the means for rapidly drawing seawater from the mooring recess comprises an empty hold in the hull and a valve opening to the mooring recess to permit water to drain into the hold.

10. An ocean mooring system according to claim 1 wherein the upper part of the buoyant element comprises at least one resilient annular member concentric with the vertical axis of the mooring element, the resilient annular member making initial contact with the mooring recess to cushion any impact between the mooring element and the vessel.

11. An ocean mooring system according to claim 10 wherein the resilient annular member makes a circle of sealing contact with the bottom of the hull so that the means for rapidly drawing seawater into the hull can pump out the region between the bottom of the hull and the upper part of the mooring element inside the circle of sealing contact.

12. An ocean mooring system according to claim 1 wherein the buoyant mooring element further comprises a lower part and means for mounting the upper part on the lower part for rotation about a vertical axis of the element, with the lines connecting the mooring element to the ocean floor being attached to the lower part so that the upper part and the vessel can swivel about the lower part when the upper part is engaged with the mooring recess in the bottom of the hull.

13. An ocean mooring system according to claim 12 wherein the means for mounting the upper part on the lower part for rotation about a vertical axis comprises a combined radial and thrust bearing, a first rotary seal located below the bearing between the upper part and the lower part, and a second rotary seal located above the bearing between the upper part and the lower part to prevent seawater from entering the bearing.

14. An ocean mooring system according to claim 12 wherein the upper part of the mooring element comprises a hollow annular tank with an inner vertical passage and an outer peripheral skirt extending below the bottom of the tank, and the lower part of the mooring element comprises a vertical cylindrical tank having a closed top and an open bottom.

15. An ocean mooring system according to claim 14 wherein the mooring element further comprises means for delivering compressed air to the cylindrical tank, and the cylindrical tank has a volume predetermined to be sufficient to raise the mooring element to the ocean surface when water in the tank has been displaced by compressed air.

16. An ocean mooring system according to claim 14 wherein the means for mounting the upper part on the lower part for rotation about a vertical axis comprises a radial bearing, a separate thrust bearing, and at least one rotary seal between the upper part and the lower part.

17. A method for mooring a vessel to the bottom of a body of water, the method comprising:

(a) anchoring a buoyant mooring element to the bottom by a plurality of angularly spaced radially extending catenary lines;

(b) adjusting the buoyancy of the element so that it is maintained at a predetermined depth with part of the anchor lines resting on the bottom;

(c) positioning the vessel over the mooring element;

(d) hoisting the mooring element by a line from the vessel to make contact with the bottom of the vessel; and (e) rapidly withdrawing water into the hull of the vessel from the region of contact by the mooring element so as to lower the hydrostatic pressure on the top of the mooring element sufficiently to create a condition of net positive buoyancy to press the mooring element against the bottom of the vessel.

18. A method for mooring a vessel to the bottom of a body of water according to claim 17 wherein step (d) comprises making sealing contact between the outer periphery of the mooring element and the bottom of the vessel, and step (e) comprises withdrawing water into the hull through an intake opening located in the bottom of the hull radially inward of the outer periphery of the mooring element.

19. A method for mooring a vessel to the bottom of a body of water according to claim 17 wherein step (d) comprises displacing water from the mooring element with compressed air prior to or during hoisting of the mooring element from the equilibrium position, so as to increase the buoyancy of the mooring element and to correspondingly decrease the lifting force exerted by the hoisting line.

20. A method for mooring a vessel to the bottom of a body of water according to claim 17 wherein step (d) comprises retrieving a flexible pipe permanently attached to the buoy and displacing water from the mooring element with compressed air supplied from the vessel through the flexible pipe prior to or during hoisting of the mooring element from the equilibrium position, so as to increase the buoyancy of the mooring element and to correspondingly decrease the lifting force exerted by the hoisting line.

21. A method for mooring a vessel tot he bottom of a body of water according to claim 20 wherein the flexible pipe permanently attached to the buoy also comprises the hoisting line.

* * * * *

UNITED STATES PATENT AND TRADEMARK OFFICE

CERTIFICATE OF CORRECTION

PATENT NO. : 5,305,703

DATED : April 26, 1994

INVENTOR(S) : Jens Korsgaard

It is certified that error appears in the above-identified patent and that said Letters Patent is hereby corrected as shown below:

Column 3, line 54, after "the" insert --invention.--.

Column 5, line 33, after "waves" insert a comma.

Column 7, line 3, after "hydraulic" insert --cylinder is in a downstroke position, and the mooring rope can--.

Column 11, line 26, change "1? 1" to --101--.

Column 16, line 31, change "tot he" to --to the--.

Signed and Sealed this

Twentieth Day of September, 1994

*Attest:*

*Attesting Officer*

BRUCE LEHMAN

*Commissioner of Patents and Trademarks*